US007029094B2

(12) United States Patent
Nakamura

(10) Patent No.: US 7,029,094 B2
(45) Date of Patent: Apr. 18, 2006

(54) FLUID CONTROL VALVE AND DROPLET DISCHARGING DEVICE

(75) Inventor: Shinichi Nakamura, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/930,757

(22) Filed: Sep. 1, 2004

(65) Prior Publication Data

US 2005/0083367 A1 Apr. 21, 2005

(30) Foreign Application Priority Data

Sep. 3, 2003 (JP) ..... 2003-311851

(51) Int. Cl.
*B41J 2/165* (2006.01)

(52) U.S. Cl. ..... 347/33; 347/22; 347/28

(58) Field of Classification Search ..... 347/7, 347/22–35, 85, 86; 239/569, 583, 99; 251/63, 251/63.5, 331
See application file for complete search history.

(56) References Cited

U.S. PATENT DOCUMENTS 4,050,078 A * 9/1977 Isayama et al. ..... 347/7
4,296,418 A * 10/1981 Yamazaki et al. ..... 347/28
6,145,954 A * 11/2000 Moore ..... 347/28
6,796,627 B1 * 9/2004 Kimura et al. ..... 347/7

FOREIGN PATENT DOCUMENTS

JP A 2002-310316 10/2002

* cited by examiner

*Primary Examiner*—Shih-Wen Hsieh
(74) *Attorney, Agent, or Firm*—Oliff & Berridge, PLC

(57) ABSTRACT

A fluid control valve capable of reducing or preventing a foam from being retained inside and reducing the likelihood or preventing the other fluid equipment placed downstream from causing a failure due to the foam, and a droplet discharging device using the fluid control valve, are provided. Fluid control valves and include a tank through which fluid flows, an inflow port through which fluid flows into the tank, an outflow port through which fluid flows out from the tank and a valve body for opening and closing the inflow port or the outflow port, the inflow port being provided below the outflow port.

1 Claim, 6 Drawing Sheets

FLUID CONTROL VALVE AND DROPLET DISCHARGING DEVICE

BACKGROUND OF THE INVENTION

1. Field of Invention

Exemplary aspects of the present invention relate to a fluid control valve and a droplet discharging device.

2. Description of Related Art

There are various types of related art fluid control valves that control flow of fluid.

For example, a related art fluid control valve which on-off controls flow of fluid flowing through the value by using a valve seat formed in a flow passage and valve body which contacts or separates from the valve seat is disclosed in Japanese Unexamined Patent Publication No. 2002-310316.

SUMMARY OF THE INVENTION

As described above, in a related art fluid control valve, when fluid is initially filled into the fluid control valve, the inside of fluid control valve is not completely filled with fluid and a foam may remain inside. Further, if a plurality of foams are retained in the fluid control valve, a larger foam may be formed by the plurality of foams joining together.

There has been a problem that if foam flows downstream together with fluid, this may cause a failure in the other fluid equipment placed downstream of the fluid control valve.

Furthermore, in the case that the above described fluid control valve is applied to an ink and cleaning liquid supply system in a droplet discharging device which discharges solvent to various base materials, for example, if there exists a foam in the fluid control valve provided in an ink supply system, the foam flows downstream together with the ink, and flows into a droplet discharging head which discharges a droplet. When the foam intrudes into the droplet discharging head, the droplet is unstably discharged due to the foam.

Furthermore, when the foam, that is retained in the fluid control valve in a cleaning liquid supply system and has become large, blocks the flow passage, the discharging amount of the cleaning liquid at the time of a head cleaning operation becomes uneven, and sufficient cleaning is not carried out. Also contaminants may remain on nozzle portions of the droplet discharging head.

For this reason, at the time of the ink droplet discharging, there has been a problem that the ink is not discharged or a flight curve of the ink occurs. Thus, an initial discharging quality of the droplet discharging head can not be secured, and drawings etc. may be defective.

Exemplary aspects of the present invention address or solve the above and/or other problems. Exemplary aspects of the present invention provide a fluid control valve which can reduce or prevent the foam from being retained inside the valve and further reduce or prevent the other fluid equipment placed downstream from causing defects due to the foam, and to provide a droplet discharging device using the fluid control valve.

A fluid control valve according to an exemplary aspect of the present invention includes a tank in which fluid flows through the inside, an inflow port through which fluid flows into the tank, an outflow port through which fluid flows out from the tank and a valve body for opening and closing the inflow port or outflow port, the inflow port being provided below the outflow port.

Because the fluid control valve of an exemplary aspect of the present invention has the inflow port below the outflow port, when fluid is initially filled into the fluid control valve, fluid flows in from the inflow port provided below the outflow port and air flows out from the outflow port provided above the inflow port. For this reason, air in the tank completely flows out from the outflow port, and no foam is retained in the tank. Because no foam is retained in the tank, no foam flows out to downstream, preventing the other fluid equipment placed downstream from causing defects due to the foam.

In order to realize the above structure, the inflow port may be provided at the lowermost part of the tank.

According to this structure, because the inflow port is provided at the lowermost part of the tank and fluid flows into from the lowermost part of the tank, no fluid flows downward of the inflow port. For this reason, because no foam circulates in the tank with downward flow, the foam more easily flows toward the outflow port and is not retained in the tank.

In order to realize the above structure, specifically, the tank is provided with an inflow passage to guide fluid to the inflow port from the outside, and the inflow passage may be placed to be upward from the horizontal direction toward the tank.

According to this structure, because the inflow passage is placed to be upward from the horizontal direction toward the tank, the foam is not retained in the inflow passage and the foam is not retained in the tank.

In order to realize the above structure, specifically, the outflow port may be provided generally at a center part of an upper surface of the tank.

According to this structure, because the outflow port is provided generally at the center part of the upper surface of the tank, the foam gathered at the upper surface of the tank easily gathers to the outflow port by fluid flow. For this reason, the foam easily flows out from the tank, and the foam is not retained in the tank.

In order to realize the above structure, specifically, the shape of the upper surface of the tank may be formed to be inclined upward to the outflow port in a tapered shape.

According to this structure, because the shape of the upper surface of the tank is formed to be inclined upward to the outflow port in a tapered shape, the foam in the tank easily rises along the inclination of the upper surface of the tank and gathers in the vicinity of the outflow port. For this reason, the foam easily flows out from the tank, and the foam is not retained in the tank.

In order to realize the above structure, specifically, an internal surface of the tank may be lyophilic processed.

According to this structure, because the internal surface of the tank is highly lyophilic, a liquid can easily adhere. For this reason, the foam does not adhere on the internal surface of the tank. Thus, the foam is not retained in the tank.

In order to realize the above structure, specifically, the internal surface of the tank may be chemically polished.

According to this structure, because the internal surface of the tank is chemically polished, the internal surface of the tank does not have unevenness, such as damage and processing marks made by machining. For this reason, the foam does not adhere on the internal surface of the tank by clinging, and the foam is hardly retained in the tank.

In order to achieve the above and/or other advantages, a droplet discharging device according to an exemplary aspect of the present invention includes a droplet discharging head provided with a plurality of nozzles to discharge a liquid material having fluidity, a cleaning device to clean a periphery part of the nozzle, a cleaning liquid supply part to discharge cleaning liquid to the cleaning device, a first supply flow passage to supply the liquid material to the droplet discharging device, a second supply flow passage to supply cleaning liquid to the cleaning liquid supply part, and a fluid control valve to control flow of the liquid material flowing in the first supply flow passage and flow of cleaning liquid flowing in the second supply flow passage, the fluid control valve using a fluid control valve according to an exemplary aspect of the present invention.

By using the fluid control valve according to an exemplary aspect of the present invention, the droplet discharging device according to an exemplary aspect of the present invention can reduce the likelihood or prevent the foam retained in the fluid control valve from flowing into the droplet discharging head and the cleaning liquid supply part. For this reason, a lack of cleaning on the periphery part of the nozzle due to the liquid material discharging failure from the droplet discharging head and a cleaning liquid discharging failure from the cleaning liquid supply part can be reduced or prevented. As a result, loss of drawings due to the liquid material discharging failure and a flight curve of the liquid material, due to the lack of cleaning on the periphery part of the nozzle, can be reduced or prevented. Thereby the initial discharging quality of the droplet discharging head can be secured.

Furthermore, the foam in the fluid control valve can be reduced or prevented from being retained. Therefore, a process to remove the foam becomes unnecessary and maintenance time is reduced to enhance the productivity.

DETAILED DESCRIPTION OF EXEMPLARY EMBODIMENTS

An exemplary embodiment of the present invention will be described with reference to FIG. 1 through FIG. 6.

Figure 1:
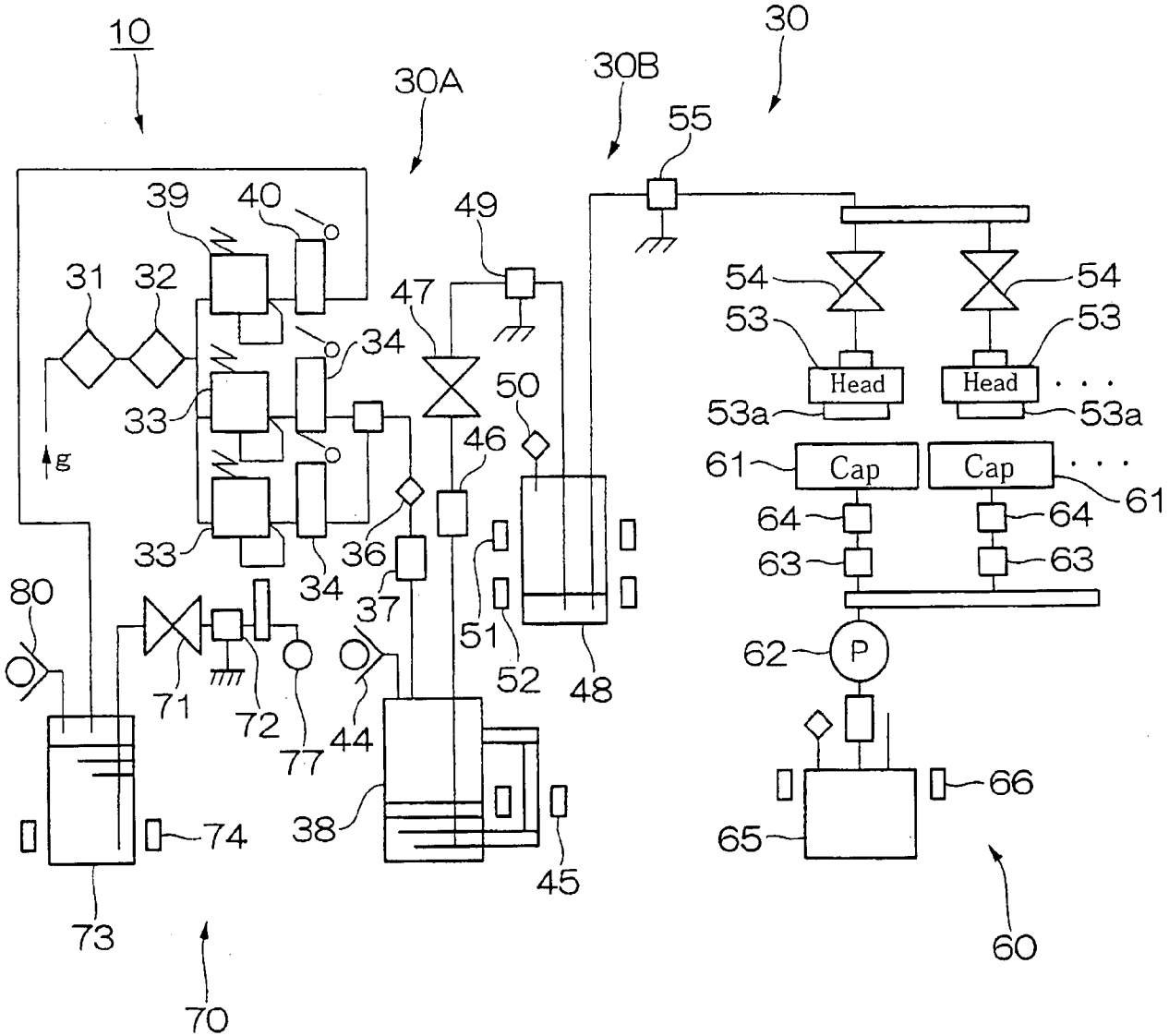
FIG. 1 is a schematic of a droplet discharging device according to an exemplary embodiment of the present invention.
Figure 2:
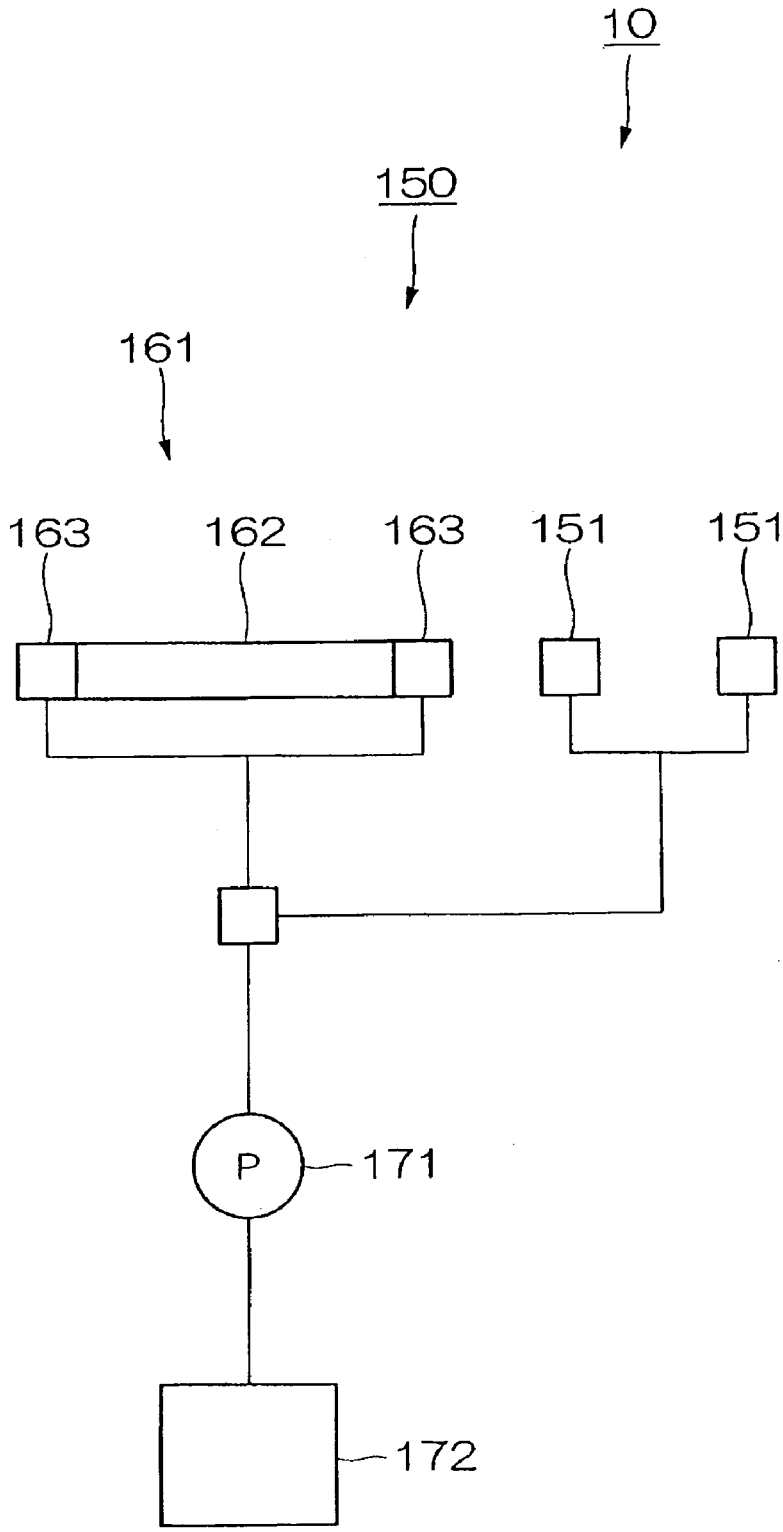
FIG. 2 is a schematic of a blank dot detecting and preventing unit according to an exemplary embodiment of the present invention.

FIG. 1 is a schematic of a droplet discharging device according to the present exemplary embodiment. FIG. 2 is a schematic of a blank dot detecting and preventing unit of the droplet discharging device according to the present exemplary embodiment.

As shown in FIG. 1 and FIG. 2, a droplet discharging device 10 includes a droplet discharging unit 30, a cap unit 60, a wiping unit (cleaning device) 70, and a blank dot detecting and preventing unit 150.

The droplet discharging unit 30 is a unit to discharge and lay down an ink droplet R on a predetermined position on a substrate (glass substrate, hereinafter, wafer Wf) from a droplet discharging head 53.

As shown in FIG. 1, the droplet discharging unit 30 includes a pressurized system 30A to supply an inert gas at a predetermined pressure, an ink droplet supply system (first supply flow passage) 30B to guide an ink droplet to the droplet discharging head and a droplet discharging head 53 to discharge the ink droplet.

In this droplet discharging unit 30, the pressurized system 30A pressure-regulates the inert gas g (such as a nitrogen gas, for example) to a predetermined pressure, and supplies the pressure-regulated inert gas g to the ink droplet supply system 30B.

First, the pressurized system 30A is described.

The pressurized system 30A includes air filters 31 and 36 to remove foreign substances, such as dust contained in the inert gas g, a mist separator 32 to remove mist, ink droplet pressure feed pressure regulating valves 33, 33 and a cleaning liquid pressure feed pressure regulating valve 39 to properly regulate pressure, ink droplet side residual pressure exhaust valves 34, 34 and a cleaning liquid side residual pressure exhaust valve 40, and an inert gas pressure detecting sensor 37 to detect the pressure of the insert gas g.

In the pressurized system 30A, at first, the inert gas g, such as the nitrogen gas, is supplied to the air filter 31, and foreign substances contained in the inert gas g are removed. Then, mist contained in the inert gas g is removed in a mist separator 32.

The inert gas g from which foreign substances and mist were removed is transferred to either one of the ink droplet supply system 30B or a cleaning liquid supply system (second supply flow passage) 70A described later depending on the work in the droplet discharging device 10. Switching between this ink droplet supply system 30B and the cleaning liquid supply system 70A is carried out by alternately turning ON/OFF an ink liquid pressure feed ON/OFF selector valve (fluid control valve) 47 described later and a cleaning liquid ON/OFF selector valve (fluid control valve) 71. An ON/OFF selector valve (fluid control valve) of an exemplary aspect of the present invention is used for these two ON/OFF selector valves, the ink liquid pressure feed ON/OFF selector valves 47 and the cleaning liquid ON/OFF selector valve 71, and a head foam elimination valve 54.

When the inert gas g is pressure-fed to the ink droplet supply system 30B by turning ON the ink liquid pressure feed ON/OFF selector valve 47 and turning OFF the cleaning liquid ON/OFF selector valve 71, the inert gas g is supplied to the droplet pressure feed pressure regulating valve 33 and pressure-regulated to a predetermined pressure. The pressure-regulated inert gas g flows through the ink droplet side residual pressure exhaust valve 34 and the air filter 36. The supply pressure of the gas is checked by the inert gas pressure detecting sensor 37. Then the gas is supplied to an ink droplet pressurized tank 38.

When the inert gas g is pressure-fed to the cleaning liquid supply system 70A by turning OFF the ink liquid pressure feed ON/OFF selector valve 47 and turning ON the cleaning liquid ON/OFF selector valve 71, the inert gas g is supplied to the cleaning liquid pressure feed pressure regulating valve 39 and pressure-regulated to a predetermined pressure. The pressure-regulated inert gas g flows through the cleaning liquid side residual pressure exhaust valve 40 and the air filter 71. The supply pressure of the gas is checked by an inert gas pressure detecting sensor 72. Then the gas is supplied to an cleaning liquid pressure feed tank 73.

Next, the ink supply system 30B is described.

As shown in FIG. 1, the ink droplet supply system 30B includes an ink droplet pressurized tank 38 and a main tank 48 to retain the ink droplet, an ink liquid pressure feed pressure detecting sensor 46 to measure the pressure of ink droplet, an ink liquid pressure feed ON/OFF selector valve 47 to control pressure-feed of the ink droplet, and a head part foam elimination valve 54 used when eliminating the foam in a droplet discharging head 53.

The ink droplet pressurized tank 38 is provided with a tank exhaust pressure valve 44 to release excessive pressure in the tank, and an ink droplet existence detecting sensor 45 to check whether there exists a predetermined amount of ink droplet by detecting a liquid level position of the ink droplet. This allows, for example, the ink droplet existence detecting sensor 45 to detect when the remaining ink droplet amount in the ink droplet pressurized tank 38 is lower than a predetermined level, and allows the ink droplet to be refilled into the ink droplet pressurized tank 38 based on this detecting signal.

The main tank 48 includes an air filter 50, a main tank part upper limit detecting sensor 51 and an ink droplet liquid level control detecting sensor 52. This allows, for example, the main tank part upper limit detecting sensor 51 to detect when the ink droplet liquid level in the main tank 48 exceeds a predetermined level, and allows the supply of the ink droplet to the main tank 48 to stop based on this detecting signal. Furthermore, the ink droplet liquid level control detecting sensor 52 is a detecting sensor to regulate water head value of the ink droplet liquid level in the main tank 48 with respect to each nozzle surface 53*a* of a plurality of droplet discharging heads 53 to within a predetermined range (for example, 25 mm±0.5 mm).

Furthermore, a flow passage part earth coupling 49 to dissipate static electricity is arranged between the ink liquid pressure feed ON/OFF selector valve 47 and the main tank 48. Similarly, a flow passage part earth coupling 55 to dissipate static electricity is arranged between the main tank 48 and the head part foam elimination valve 54.

When the inert gas g is supplied to the ink droplet pressurized tank 38 in the ink droplet supply system 30B, the ink droplet level is pressed downward by the inert gas g, and pressure-fed from the ink droplet pressurized tank 38. The pressure-fed ink droplet, whose pressure is measured by the ink liquid pressure feed pressure detecting sensor 46, flows through the ink liquid pressure feed ON/OFF selector valve 47, and is then supplied to the main tank 48.

The ink droplet, which is supplied to the main tank 48, is further supplied to the droplet discharging head 53 through the head part foam elimination valve 54 from the main tank 48.

By closing the upstream side flow passage of the droplet discharging head 53, the head part foam elimination valve 54 is allowed to increase a suction flow rate when sucking droplets in the droplet discharging head 53 with a cap unit 60 described later, and to quickly exhaust the foam in the droplet discharging head 53.

Next, the droplet discharging head 53 is described.

Figure 3A:
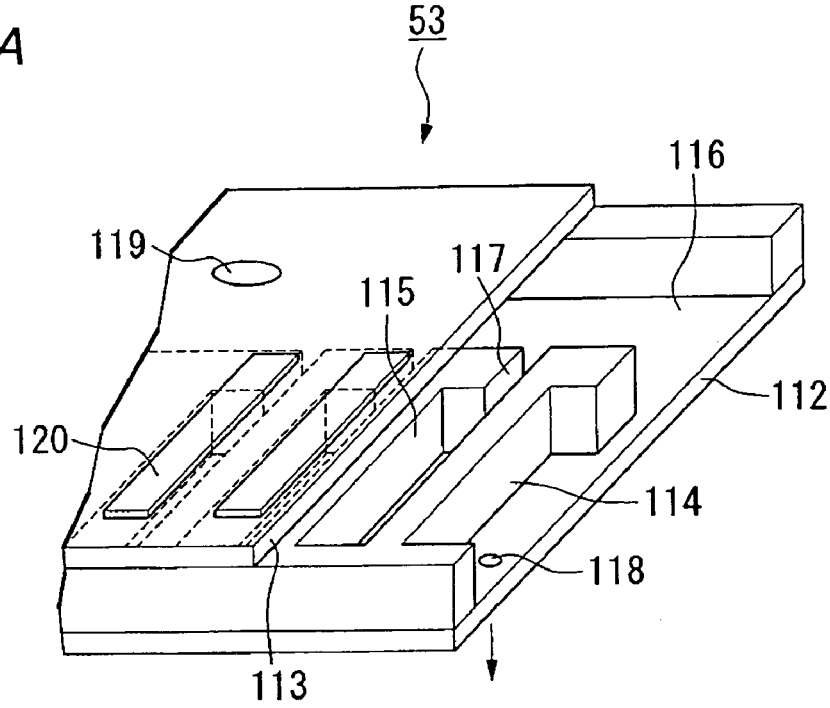
FIGS. 3A and 3B are schematics of a droplet discharging head according to an exemplary embodiment of the present invention.

FIGS. 3A and B are schematics of the droplet discharging head.

In the present exemplary embodiment, an ink jet method is used as a droplet discharging method. In this ink jet method, the droplet discharging head 53, for example as shown in FIG. 3A, includes a nozzle plate 112 made of stainless steel and a vibrating plate 113 which are joined through a partitioning member (reservoir plate) 114. Between the nozzle plate 112 and the vibrating plate 113, a plurality of cavities 115 and reservoirs 116 are formed by the partitioning member 114. These cavities 115 and reservoirs 116 are linked through a flow passage 117.

Each cavity 115 and the inside of the reservoirs 116 are filled with a liquid material (lens material) to be discharged. Between these, the flow passage 117 functions as a supply port to supply the liquid material to the cavities 115 from the reservoirs 116. Furthermore, on the nozzle plate 112, a plurality of hole-shaped nozzles 118 to spray the liquid material from the cavity 115 are formed in array lengthwise and breadthwise. A hole 119 opened to the inside of the reservoir 116 is formed on the vibrating plate 113, and a liquid material tank (not shown) is connected to this hole 119 through a tube (not shown).

Figure 3B:
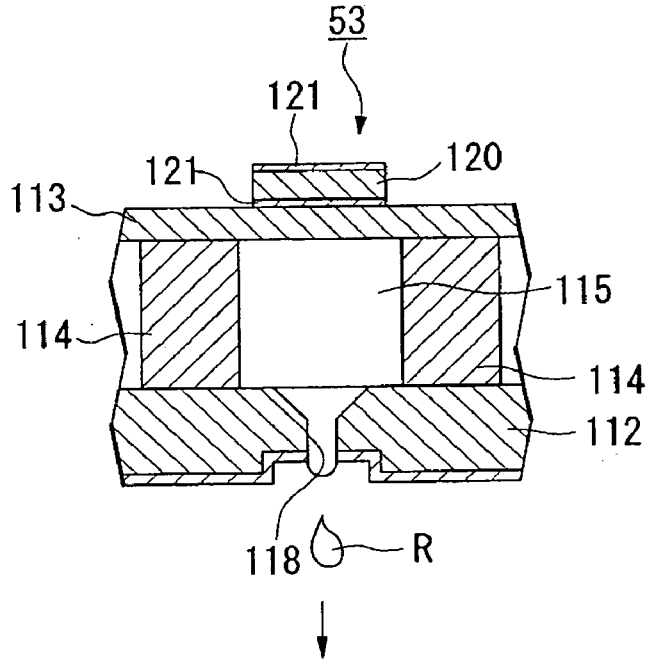

As shown in FIG. 3B, a piezoelectric element (piezo actuator) 120 is jointed on the surface of the vibrating plate 113 which is opposed to the surface facing the cavity 115. This piezoelectric element 120 sandwiched between a pair of electrodes 121 and 121, is formed to be flexibly bent so as to protrude outward by electric conduction, and functions as a discharging device in an exemplary aspect of the present invention.

The vibrating plate 113 on which the piezoelectric element 120 is joined under such a structure is integrated with the piezoelectric element 120 and is flexibly bent outward at the same time, which allows the volume of the cavity 115 to be increased. Then, when the inside of the cavity 115 and the inside of the reservoir 116 are linked and the liquid material is filled in the reservoir 116, the volume of the liquid material equivalent to the increased volume flows into the cavity 115 from the reservoir 116 through the flow passage 117.

When the electric conduction to the piezoelectric element 120 is released from this state, the piezoelectric element 120 together with the vibrating plate 113 return to the original shape. Accordingly, the volume of the cavity 115 also returns to the original volume. Therefore, the pressure of the liquid material inside the cavity 115 increases and then a droplet 122 of the liquid material is discharged from the nozzle 118.

In addition, as a discharging device of the droplet discharging head, other than electromechanical converter using the above described piezoelectric element (piezo actuator) 120 may be used, for example, methods such as an electric-heat converter as an energy generating element and continuous methods, such as an electric charge control type and a pressurized vibrating type, a static electricity suction type, and further, a method to emit electro-magnetic waves, such as a laser to generate heat and discharge the liquid material by action of this heat generation.

Following the above described droplet discharging unit 30, a cap unit 60 is described.

As shown in FIG. 1, the cap unit 60 includes a cap 61 being pressed to the droplet discharging head 53, a droplet suction pump 62 to suck the droplet, a droplet recycle tank 65 to retain the sucked droplet, a needle valve 63 used to regulate the suction pressure, and a droplet suction pressure detecting sensor 64.

The droplet recycle tank 65 is provided with a recycle tank upper limit detecting sensor 66. For example, when the liquid level in the droplet recycle tank 65 exceeds a predetermined level, this level is detected by the recycle tank upper limit detecting sensor 66, and the ink droplet in the droplet recycle tank 65 is transferred to the recycle process based on this detecting signal.

According to the above described cap unit 60, at first, the cap 61 is pressed to the nozzle surface 53*a* of each droplet discharging head 53 from directly below before starting to discharge the droplet R from each droplet discharging head 53. By using the suction force of the droplet suction pump 62, the negative pressure is applied to each nozzle of the droplet discharging head 53 to fill up to the nozzle surface 53*a* with the droplet, and to remove clogging in each nozzle, the negative pressure is applied to each nozzle of each droplet discharging head 53 to suck. Further, the nozzle surface 53*a* is covered with the cap 61 to keep moisture so that droplets in each nozzle are not dried at standby when production is not carried out.

Following the above described cap unit 60, a wiping unit 70 is described.

Figure 4:
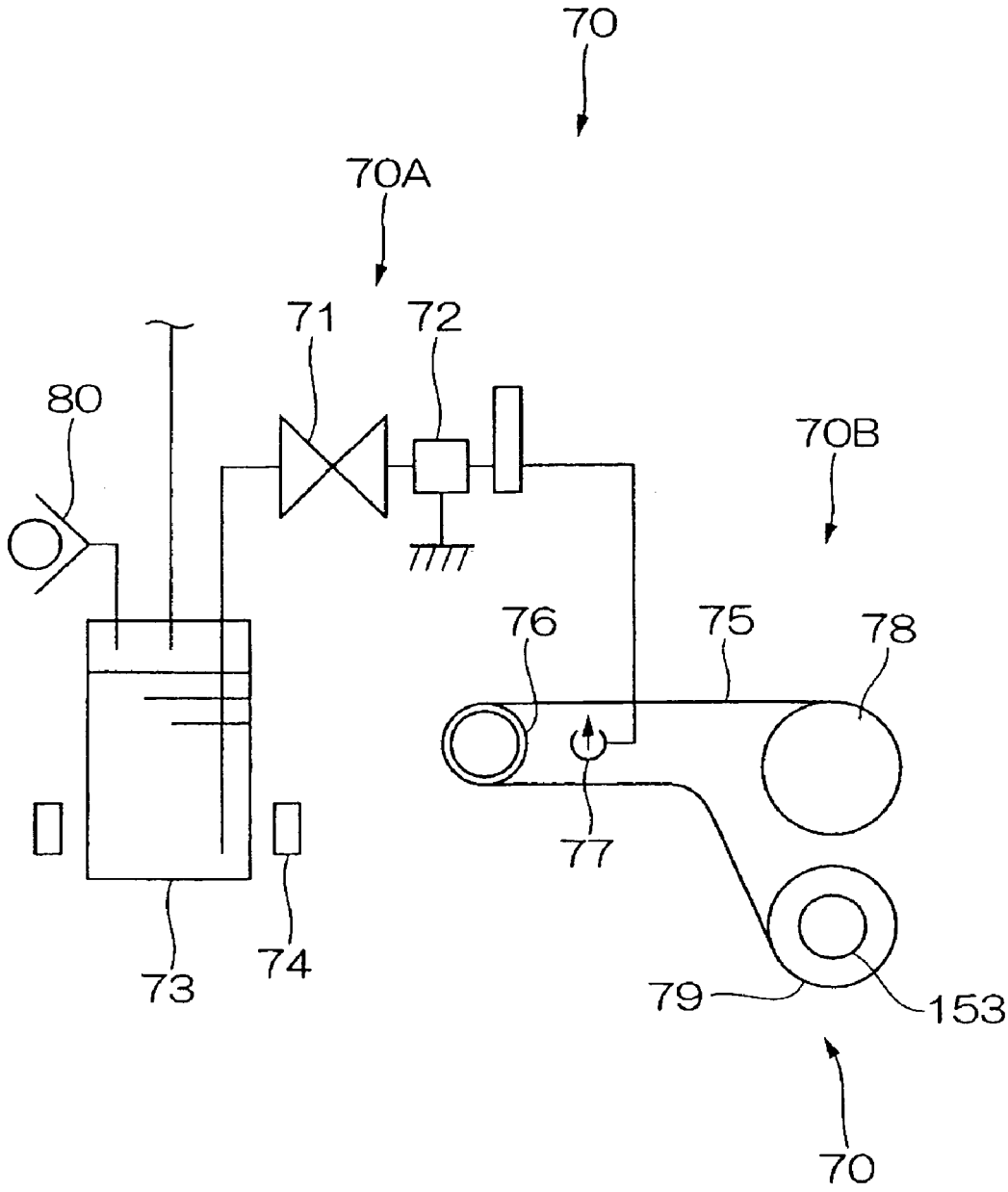
FIG. 4 is a schematic of a wiping unit according to an exemplary embodiment of the present invention.

FIG. 4 is a schematic of a wiping unit.

The wiping unit 70 shown in FIG. 1 and FIG. 4, periodically or occasionally clean each nozzle surface 53*a* of each above described droplet discharging head 53 at the same time.

Furthermore, as shown in the FIG. 1 and FIG. 4, the wiping unit 70 include a cleaning liquid supply system 70A to supply cleaning liquid, and a nozzle surface cleaning system 70B to clean the nozzle surface 53*a*.

The cleaning liquid supply system 70A includes a cleaning liquid tank 73 to store cleaning liquid, a cleaning liquid ON/OFF selector valve 71 to control flow of cleaning liquid, a cleaning liquid supply part 77 to spray cleaning liquid to a wiping sheet 75 described later. A flow passage part earth coupling 72 to dissipate static electricity from the flow passage is provided between the cleaning liquid ON/OFF selector valve 71 and the cleaning liquid supply part 77.

Furthermore, the cleaning liquid tank 73 is provided with a cleaning liquid existence detecting sensor 74 to check whether there exists a predetermined amount of the cleaning liquid by detecting the liquid level position of the cleaning liquid, and a tank exhaust pressure valve 80 to release excessive pressure in the tank. For example, when the cleaning liquid remaining amount in the cleaning liquid tank 73 lowers the predetermined level, the level is detected by the cleaning liquid existence detecting sensor 74. Then cleaning liquid is refilled into the cleaning liquid tank 73 based on this detecting signal.

As shown in FIG. 4, the nozzle surface cleaning system 70B includes a wiping sheet 75 to wipe each nozzle surface 53*a*, a roller 76 to press the wiping sheet 75 toward each nozzle surface 53*a*, a wind-out roller 78 to supply the wiping sheet 75, a winding roller 79 to wind the wiping sheet 75 after wiping each nozzle surface 53*a* and an electric motor 153 to rotary drive the winding roller 79.

As the wiping sheet 75, a polyester 100% woven cloth may be used, for example. Furthermore, the roller 76 is a rubber roller, and has elasticity to repel pressing force onto the periphery.

According to the cleaning liquid supply system 70A of this wiping unit 70, as described above, the pressure-regulated inert gas g is supplied to the cleaning liquid pressure feed tank 73. For this reason, the inside of the cleaning liquid pressure feed tank 73 is pressurized. The cleaning liquid, which is retained inside, flows through the cleaning liquid ON/OFF selector valve 71, and is then pressure-fed to the cleaning liquid supply part 77 and sprayed to the wiping sheet 75.

Furthermore, according to the above described nozzle surface cleaning system 70B, the wiping sheet 75 which is wound out from the wind-out roller 78 can be pressed by the roller 76 while supplied toward each nozzle surface 53*a*, and a new cleaning surface of the wiping sheet 75 can be continuously supplied to each nozzle surface 53*a*. The wiping sheet 75 is structured to be pressed to each nozzle surface 53*a* by the pressing force of the roller 76. Therefore, the cleaning surface can securely make contact with each nozzle surface 53*a*.

Following the above described wiping unit 70, a blank dot detecting and preventing unit 150 is described.

This blank dot detecting and preventing unit 150, as shown in FIG. 2, checks clogging in each nozzle of each nozzle unit 53 and reduces their likelihood or prevents them.

As shown in FIG. 2, the blank dot detecting and preventing unit 150 includes a blank dot detecting part 151, a blank dot preventing part 161, a suction pump 171 connected to the blank dot detecting part 151 and the blank dot preventing part 161, and a waste liquid tank 172 to store ink droplets sucked by the suction pump 171.

The blank dot detecting part 151 includes a laser device (not shown) emitting laser light to the inside thereof, and a laser detecting part (not shown) to detect the emitted laser light.

The blank dot preventing part 161 includes a table 162 on which a wafer Wf is placed, and a pre-discharging part 163 provided on the end of the table 162.

According to the blank dot detecting part 151 in this blank dot detecting and preventing unit 150, each droplet discharging head 53 is moved above to the blank dot detecting part 151 and inspection can be carried out by waste discharging the ink droplet from each droplet discharging head 53 so as to shield laser light emitted from the laser device (not shown).

For example, if the laser detecting part (not shown) keeps detecting the laser light despite what the waste discharging is instructing, it is judged that there is a possibility of the nozzle clogging and the droplet not coming out and thereby a blank dot occurring on the product. Then, the nozzle of the droplet discharging head 53 in defect is sucked and the clogging can be removed by the above described cap unit 60.

Furthermore, according to the blank dot preventing part 161, before discharging the ink droplet to the wafer Wf, each droplet discharging head 53 can be moved above the pre-discharging part 163, and the ink droplet can be pre-discharged (flushing) from each droplet discharging head 53. In other words, at the initial discharging, when the flight of the ink droplet is unstable, the ink droplet is pre-discharged to the pre-discharging part 163, and the ink droplet can be discharged on the wafer Wf after the flight of the ink droplet is stable. As a result, the occurrence of blank dots can be reduced or prevented.

Next, an ink liquid pressure feed ON/OFF selector valve, a cleaning liquid ON/OFF selector valve and a head foam elimination valve 54, which are main features of the present exemplary embodiment, are described.

Figure 5:
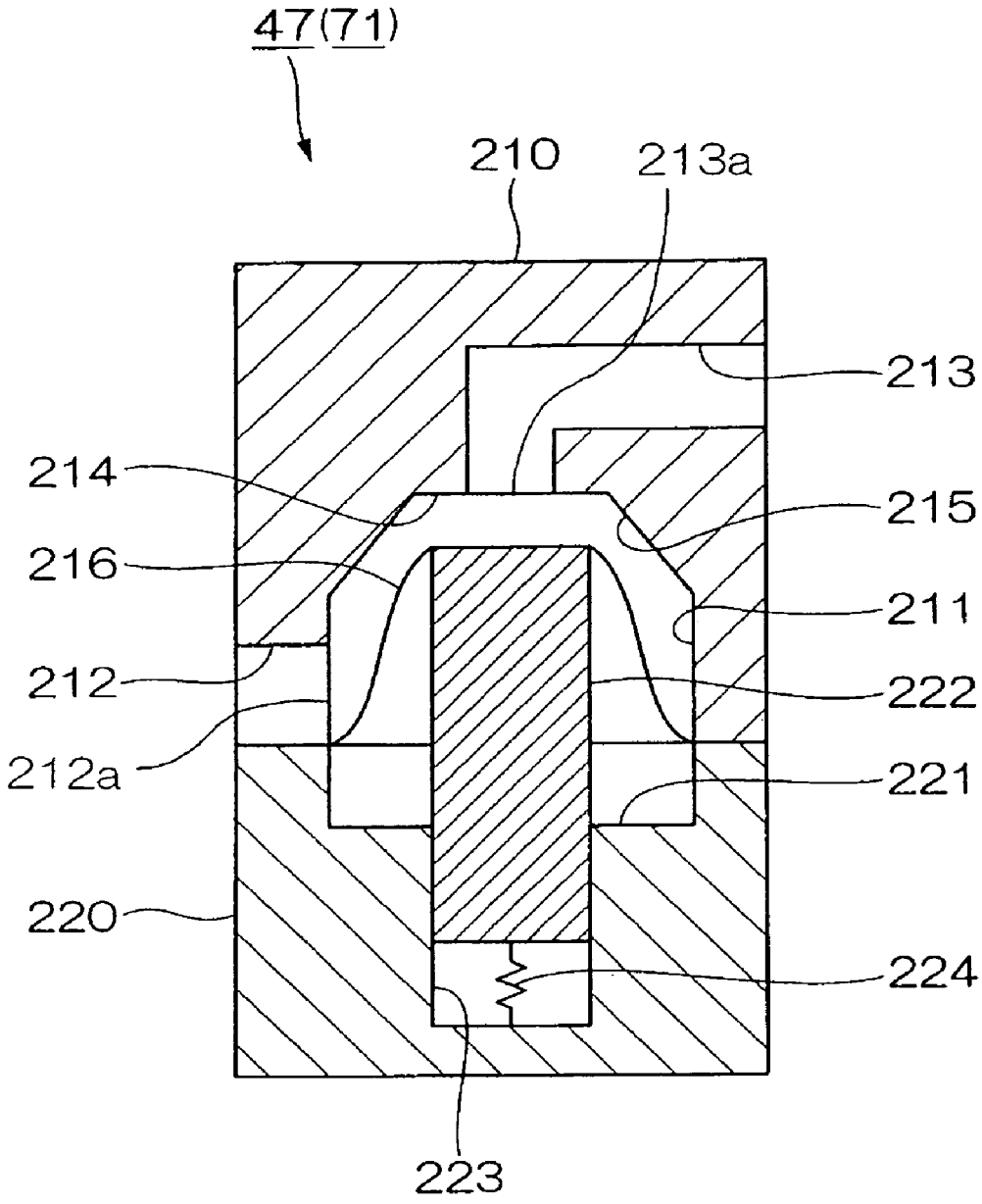
FIG. 5 is a schematic of an ink liquid pressure feed ON/OFF selector valve according to an exemplary embodiment of the present invention.
Figure 6:
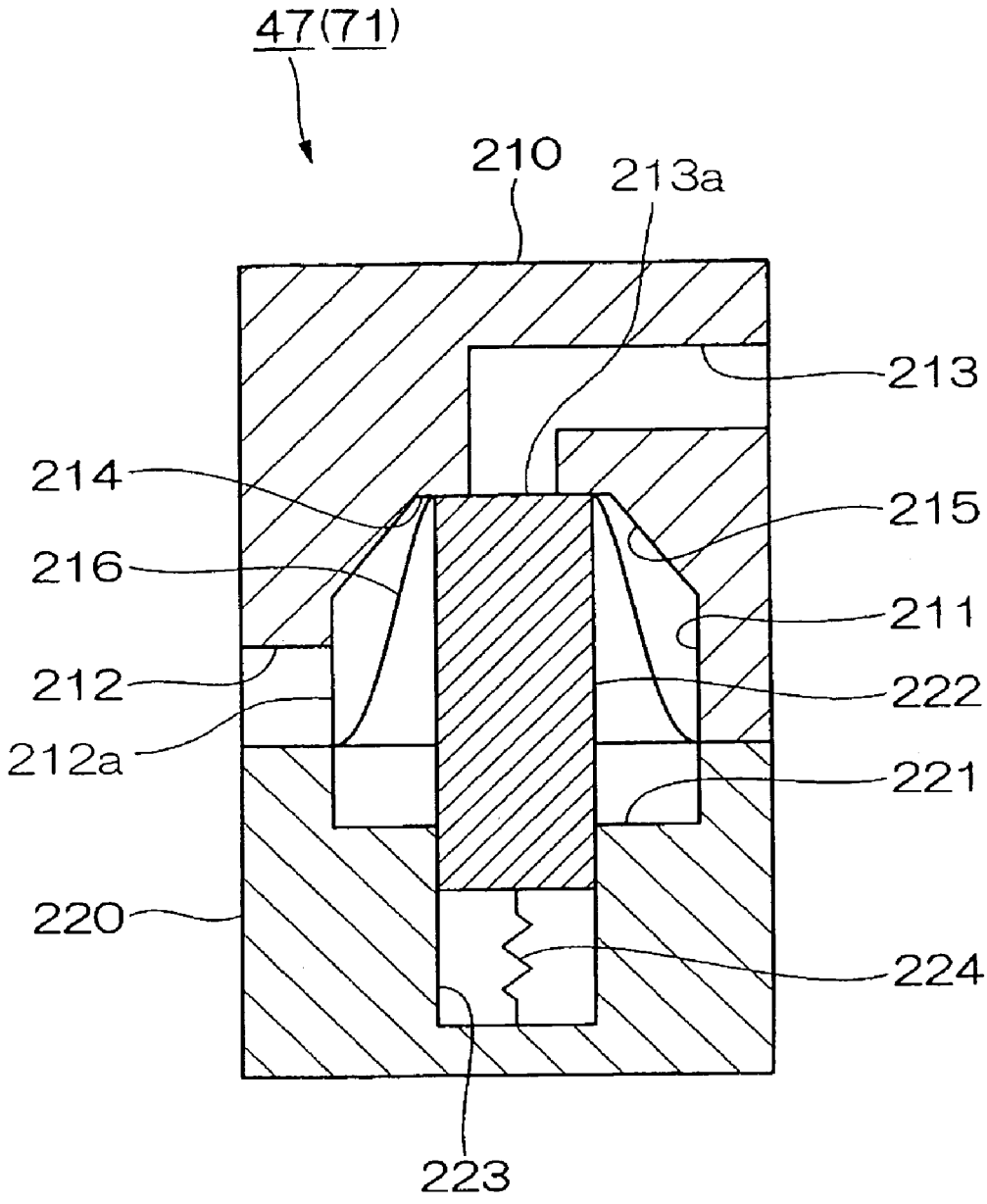
FIG. 6 is a schematic of an ink liquid pressure feed ON/OFF selector valve according to an exemplary embodiment of the present invention.

FIG. 5 is a schematic of when the ink liquid pressure feed ON/OFF selector valve is ON. FIG. 6 is a schematic of when the ink liquid pressure feed ON/OFF selector valve is OFF.

The structures, operations and effects of the ink liquid pressure feed ON/OFF selector valve 47, the cleaning liquid ON/OFF selector valve 71 and the head foam elimination valve 54 are nearly the same. Therefore, here, the ink liquid pressure feed ON/OFF selector valve 47 is described and the descriptions of the cleaning liquid ON/OFF selector valve 71 and head foam elimination valve 54 are omitted.

As shown in FIG. 5 and FIG. 6, the ink liquid pressure feed ON/OFF selector valve 47 includes a combination of an upper part housing 210 and a lower part housing 220 which are made of stainless material for example. In the upper part housing 210, a tank 211 opening to the lower part housing 220, an inflow passage 212 connected to the lowermost part of the side of the tank 211, and an outflow passage 213 connected to the generally center part of the upper surface of the tank 211, are formed.

The lower part housing 220 is provided with a concave part 221 opening to the upper part housing 210, a valve body 222 pressing up a diaphragm 216 and contacting and separating with a valve seat 214, a valve body housing part 223 in which the valve body 222 slide moves, a spring 224 provided on the lower surface of the valve body housing part 223 and applying force downward on the valve body 222, and an air supply part (not shown) supplying air to drive the valve body 222 to the valve body housing part 223.

On the upper surface of the tank 211, a valve seat 214 contacting the valve body 222 described later is formed in the periphery of an outflow port 213*a* of the outflow passage 213, and a tapered surface 215 inclined upward to the valve seat 214 is formed. An inflow port 212*a* of the inflow passage 212 is formed on the lowermost part on the side of the tank 211. The opening part on the side of the lower part housing 220 of the tank 211 is provided with a diaphragm 216 having flexibility so as to block this opening part. In addition, the internal surface of the tank 211 is chemically polished by chemicals which dissolve the material (stainless steel in the present exemplary embodiment) of the upper part housing 210, and unevenness, such as processing marks on the internal surface of the tank 211, is removed.

The inflow passage 212 is provided in a substantially horizontal direction in the present exemplary embodiment. However, it may be provided to be inclined upward to the tank 211. By providing the inflow passage 212 to be inclined upward in this way, the foam can be reduced or prevented from being retained in the inflow passage 212. Furthermore, hydrophilic film may be formed on the internal surface of the tank 211, or the internal surface of the tank 211 may be processed to be hydrophilic. By carrying out such a processing, the surface of the inside of the tank 211 has higher lyophilic properties and liquid can easily adhere. For this reason, the foam does not adhere on the surface of the inside of the tank and the foam is not retained in the tank.

The outflow passage 213 is at first provided in a generally vertical upper direction from the tank 211, and then provided in a generally horizontal direction. However, this is not limited to the generally horizontal direction, and may be provided to be inclined upward to the outside from the tank 211. By providing the outflow passage 213 to be inclined upward in this way, foam retained in the outflow passage 213 can be reduced or prevented.

When the above described ink liquid pressure feed ON/OFF selector valve 47 is in the ON state, as shown in FIG. 5, the air supply to the valve body housing part 223 stops, and the valve body 222 is drawn downward by the spring 224. Then, the valve seat 214 is separated from the valve body 222, and the ink droplet flows through the gap between the valve seat 214 and valve body 222 and flows into the outflow passage 213.

Furthermore, when the ink liquid pressure feed ON/OFF selector valve 47 is in the OFF state, as shown in FIG. 6, the air is supplied to the valve body housing part 223, and the valve body 222 is pushed upward by the air force. Then, the valve seat 214 and the valve body 222 contact through the diaphragm 216, and inflow of the ink droplet in the tank 211 to the outflow passage 213 is stopped.

According to the ink liquid pressure feed ON/OFF selector valve 47 of the above structure, because the inflow port 212*a* is provided below the outflow port 213*a*, when the ink droplet is initially filled into the ink liquid pressure feed ON/OFF selector valve 47, the ink droplet flows from the inflow port 212*a*, and the air flows out from the outflow port 213*a*. Accordingly, all of the air in the tank 211 flows out from the outflow port 213*a*, and the foam is not retained in the tank. Because the foam is not retained in the tank 211, the foam does not flow out to downstream, thereby the droplet discharging head 53 placed in the downstream can be reduced or prevented from causing failure due to the foam.

Furthermore, because the inflow port 212*a* is provided at the lowermost part of the tank 211, the ink droplet flows in from the lowermost part of the tank 211, and the ink droplet does not flow downward of the inflow port 212*a*. Accordingly, the foam does not circulate in the tank 211 with the downward flow, and the foam more easily flows toward the outflow port. Thus, the foam is not retained in the tank 211.

Because the outflow port 213*a* is provided generally at the center part on the upper surface of the tank 211, and the upper surface of the tank 211 is formed to be shaped inclining upward to the outflow port 213*a* in a tapered shape, the foam in the tank 211 easily gathers in the vicinity of the outflow port. Accordingly, the foam easily flows out from the tank 211. Thus, the foam is hardly retained in the tank 211.

Because the internal surface of the tank 211 is smoothly finished by chemical polishing, the internal surface of the tank 211 does not have unevenness such and processing marks. Accordingly, because there is no unevenness, the foam does not adhere on the internal surface of the tank 211. Thus, the foam is hardly retained in the tank 211.

Furthermore, according to the droplet discharging device 10 using the ink liquid pressure feed ON/OFF selector valve 47, the cleaning liquid ON/OFF selector valve 71 and the head foam elimination valve 54, the foam, retained in the ink liquid pressure feed ON/OFF selector valve 47, the cleaning liquid ON/OFF selector valve 71 and the head foam elimination valve 54, can be reduced or prevented from flowing into the droplet discharging head 53 and the cleaning a liquid supply part 77. Accordingly, the lack of cleaning on the peripheral part of the nozzle 118 due to the ink droplet discharging failure from the droplet discharging head 53 and the cleaning liquid discharging failure from the cleaning liquid supply part 77 can be reduced or prevented. As a result, loss of drawings due to the ink droplet discharging failure and the flight curve of the ink droplet due to the lack of the cleaning on the peripheral part of the nozzle 118 can be reduced or prevented, thereby the initial discharging quality of the droplet discharging head 53 can be secured.

Furthermore, the foam in the ink liquid pressure feed ON/OFF selector valve 47, the cleaning liquid ON/OFF selector valve 71 and the head foam elimination valve 54 can be reduced or prevented from being retained. Therefore, a process to remove the foam becomes unnecessary and maintenance time is reduced to enhance the productivity.

Moreover, the technical scope of the present invention is not limited to the above exemplary embodiments. It is possible to make changes in the scope and not depart from the spirit of the present invention.

For example, in the above exemplary embodiment, the present invention has been described to be adapted to a droplet discharging device. However, the present invention is not limited to the droplet discharging device and can be adapted to other various fluid control device.

What is claimed is:

1. A droplet discharging device, comprising:

a droplet discharging head provided with a plurality of nozzles to discharge a liquid material having fluidity;

a cleaning device to clean a peripheral part of the nozzles;

a cleaning liquid supply part to discharge cleaning liquid to the cleaning device;

a first supply flow passage to supply the liquid material to the droplet discharging device;

a second supply flow passage to supply the cleaning liquid to the cleaning liquid supply part; and a fluid control valve to control flow of the liquid material flowing in the first supply flow passage and flow of cleaning liquid flowing in the second supply flow passages, respectively, the fluid control valve having:

a tank through which fluid flows;

an inflow port through which fluid flows into the tank;

an outflow port through which fluid flows out from the tank; and a valve body to open and close the inflow port or the outflow port, the inflow port being provided below the outflow port.

* * * * *